US012104792B2

(12) United States Patent
Dillon

(10) Patent No.: US 12,104,792 B2
(45) Date of Patent: Oct. 1, 2024

(54) LIGHTER

(71) Applicant: Reilly M. Dillon, Eden Prairie, MN (US)

(72) Inventor: Reilly M. Dillon, Eden Prairie, MN (US)

( * ) Notice: Subject to any disclaimer, the term of this patent is extended or adjusted under 35 U.S.C. 154(b) by 216 days.

(21) Appl. No.: 17/476,432

(22) Filed: Sep. 15, 2021

(65) Prior Publication Data

US 2022/0082255 A1 Mar. 17, 2022

Related U.S. Application Data

(60) Provisional application No. 63/078,651, filed on Sep. 15, 2020.

(51) Int. Cl.

| | |
|---|---|
| ***F23Q 2/50*** | (2006.01) |
| ***F23Q 2/36*** | (2006.01) |
| ***F23Q 2/46*** | (2006.01) |

(52) U.S. Cl.

CPC ..... *F23Q 2/50* (2013.01); *F23Q 2/36* (2013.01); *F23Q 2/46* (2013.01)

(58) Field of Classification Search

CPC ..... F23Q 2/36; F23Q 2/04; F23Q 2/46; F23Q 2/50

See application file for complete search history.

(56) References Cited

U.S. PATENT DOCUMENTS

| | | | |
|---|---|---|---|
| 2,424,781 | A | 7/1947 | Vanetzian |
| 2,490,300 | A | 12/1949 | Hettinger et al. |
| 2,867,753 | A | 1/1959 | Quandt |
| 2,932,960 | A | 4/1960 | Ireland |
| 3,280,600 | A | 10/1966 | Meyers |

(Continued)

FOREIGN PATENT DOCUMENTS

| | | | | |
|---|---|---|---|---|
| GB | 1426566 | A | 3/1976 | |
| WO | WO-2006048468 | A1 * | 5/2006 | ..... F23Q 2/36 |

(Continued)

OTHER PUBLICATIONS

PCT International Search Report and Written Opinion in International Application No. PCT/US2021/050559, dated Feb. 3, 2022, 18 pages.

*Primary Examiner* — Alfred Basichas

(74) *Attorney, Agent, or Firm* — Christensen, Fonder, Dardi & Herbert PLLC; Douglas J. Christensen; Timothy J. Busse

(57) ABSTRACT

A lighter having a main fuel containment housing body and a forward hinged lid with a closed position and an open position, the open position providing access to the flame generator assembly. The flame generator assembly providing a wind shield with a flame outlet that, when the lighter is in an operation orientation, is directed upwardly and in a direction generally perpendicular to the major dimension of the lighter in the closed position. The windshield having dimples with apertures extending outwardly for reducing wind while providing oxygen. The lighter may have a forward sleeve with a closeable lid, the sleeve extending around the four sides of the housing and slidable on the fuel containment housing. An actuation portion effects a transition from the closed position to an operational position, opening the lid and sliding the sleeve downwardly exposing the flame generation system out of an opening in the sleeve.

17 Claims, 16 Drawing Sheets

(56) References Cited

U.S. PATENT DOCUMENTS

| | | | | |
|---|---|---|---|---|
| 3,311,789 | A | 3/1967 | Hermann | |
| 3,353,376 | A | 11/1967 | Tackett | |
| 3,521,985 | A | 7/1970 | Chrisman et al. | |
| 4,128,393 | A | 12/1978 | Sneed | |
| 4,152,109 | A * | 5/1979 | Schaffer | F23Q 2/32<br>131/243 |
| 4,531,906 | A * | 7/1985 | Mizukami | F23Q 2/50<br>431/146 |
| 5,055,034 | A | 10/1991 | Wang | |
| 7,654,821 | B2 | 2/2010 | Vitantonio et al. | |
| 2014/0011144 | A1* | 1/2014 | Hancock | F23Q 2/50<br>431/350 |
| 2016/0018108 | A1* | 1/2016 | Rahbar | F23Q 2/167<br>431/131 |
| 2018/0299125 | A1* | 10/2018 | Tullis | F23Q 2/40 |
| 2019/0383487 | A1* | 12/2019 | Omokhodion | F23Q 2/50 |
| 2022/0082255 | A1 | 3/2022 | Dillon | |

FOREIGN PATENT DOCUMENTS

| | | | |
|---|---|---|---|
| WO | WO2007140053 | A2 | 12/2007 |
| WO | WO2022060912 | | 9/2021 |

* cited by examiner

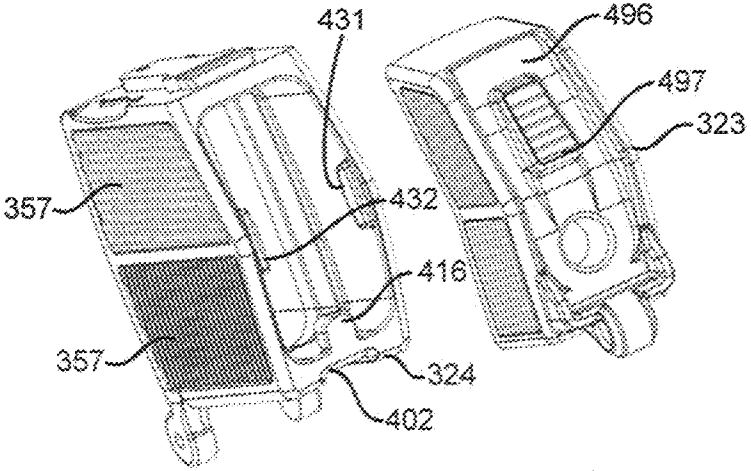
FIG. 21
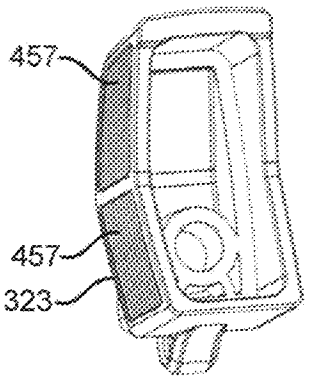
FIG. 22
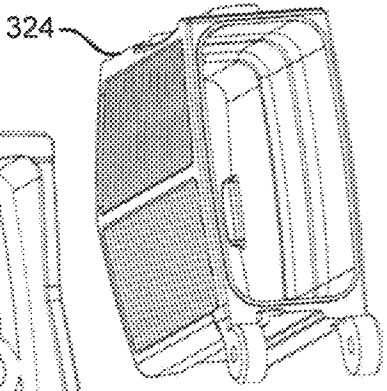
FIG. 23
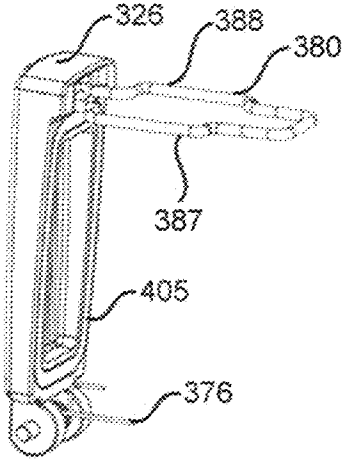
FIG. 24
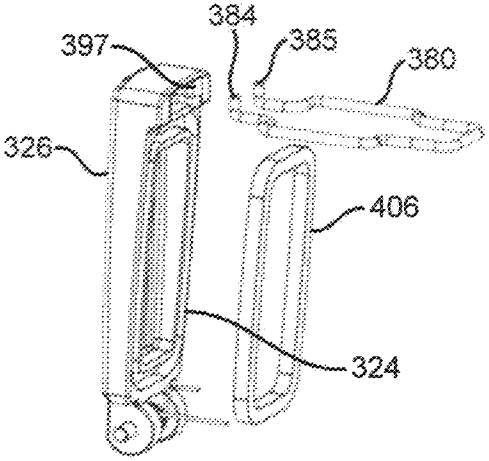
FIG. 25
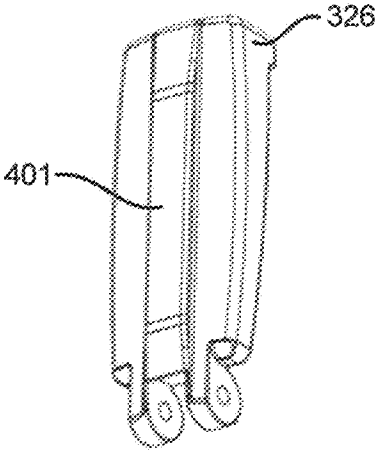
FIG. 26
FIG. 27

LIGHTER

This application claims priority to U.S. Provisional Pat. App. 63/078,651 filed Sep. 15, 2021. Said application is incorporated by reference herein.

BACKGROUND OF THE INVENTION

Refillable lighters are utilized for lighting cigarettes, cigars, for starting campfires and the like. Common refillable lighters utilize butane or liquid lighter fluid, for example naphtha, for the fuel. A disadvantage with butane is that is performance degrades in extreme cold conditions. Most lighters that utilize liquid lighter fluid are not fluid tight and can leak the liquid lighter fluid and/or the lighter fluid evaporates in a relatively short period of time. Any improvements in the performance of lighters would be well received by the lighter-using public.

SUMMARY OF THE INVENTION

A fueled lighter for cigarettes, cigars, and the like having a main fuel containment housing body and a forward lighting end, with a forward hinged lid having closed position and an open position, the open position providing access to a flame generator assembly. The flame generator assembly providing a wind shield with a flame outlet that is perpendicular to the major dimension and elongate axis of the lighter. When the flame generator is actuated, this orients the flame upwardly with the housing body extending generally horizontally or slightly tilted from the horizontal. The flame generator assembly comprising a flame generator base with a fuel port positioned into the wind shield and an ignition means adjacent to the fuel port. The flame generator base is unitary or integrated with a post extending from the flame generator base, rearwardly. The post having a threaded end exposed at a rearward end of the housing. A threaded connector, which may be configured as a knob, attaches to the threaded end of the post and is tightened securing the fuel containment housing together that defines fuel reservoir. In an embodiment, the post and threaded connector hold a rearward end cap in a sealing arrangement with the housing. In an embodiment, the post and threaded connector hold the flame generator base in a sealing engagement with the housing.

In embodiments, the lighter has a forward sleeve with a closeable lid, the sleeve extending around the four sides of the housing and slidable on the fuel containment housing. The forward sleeve with the closeable lid having a first closed position on the containment housing where the lid is closed on the sleeve, and the sleeve with lid is forwardly positioned with respect to the fuel containment housing, and where the sleeve and closed lid enclose the flame generator assembly, including the wind shield and wick. In embodiments, the wind shield is entirely positioned rearwardly of the lid and is totally within the confines of the sliding forward sleeve in the closed position. The lighter further having an actuation portion that activates a transition from the closed position to an operational position. In the operational position, the lid is released from the sleeve and a bias to the lid causes the lid to rotate about 270 degrees to lay along a lower margin of the sleeve. Additionally, in the transition, the fuel containment housing moves forwardly within the sleeve such that at the operational position the windshield with wick projects forwardly out of the sleeve.

In embodiments, the flame generator base having a periphery that sealingly engages with the housing and also sealingly engages with the lid hinged to the housing hen the lid is in the closed position. The sealing engagements may be provided by a pair of O-rings. The fuel port may include a wick extending from an eyelet in the flame generator base, the wick extending into the fuel reservoir defined by the fuel containment housing body.

In embodiments, the post having a bore for receiving flints, the bore extending to a flint wheel rotatably positioned below the wind shield when the lighter is in the operational position. A spring may bias the flints into engagement with the flint wheel. In embodiments, a central axis of the bore with the flints is positioned forward of the axis of the rotatable flint wheel. An upper portion of the flint wheel is positioned in a lower slot defined in the windshield.

A feature and advantage of embodiments where the lid or cover is substantially flat and does not cover the windshield when in a closed position. This reduces the cumbersome extra volume of a cup shaped lighter lid when in an operational position.

A feature and advantage of embodiments is that the body configured as a fuel housing is sealingly attached to the flame generator base of the lighter with one or more O-rings sealing the connection. Moreover, when the lid is closed, an O-ring seals the lid also to the flame generator base. All component junctures providing a leakage or evaporation pathway are sealed with O-rings, providing a lighter that will retain its fuel much longer than a conventional liquid fuel lighter.

A feature and advantage of embodiments is that the wind shield opens generally at a 90 degree angle from the greater dimension of the body. This allows the lighter to be held horizontally with the wind shield open in an upwardly direction.

A feature and advantage of embodiments is that the wind shield has a plurality of outwardly projecting tapered nozzle portions. Such outwardly projection nozzles are believed to be more effective than simple holes in providing wind protection while allowing sufficient air for combustion. As air enters the narrow opening and the opening expands on the inside of nozzle, the air velocity is reduced more so that with simple aperture in a wall.

A feature and advantage of embodiments is a hinged lid that is retained in a sealed closed position by a pivoting latch. Additionally, a U-shaped pivoting latch provides a secondary securement of the hinged lid. The U-shaped pivoting latch pivots at a lower having a latched position where it extends forwardly toward the lid, and an unlatched position where A lower integral or unitary latch bracket extends downwardly from the housing. A first latch has a pivoting latch lever with a latching end that hooks onto a feature on the hinged lid and an opposite manual actuation portion that can be depressed to disengage the latching end from the hinged lid. The lever may be spring loaded to urge it into the latch position.

A feature and advantage is a flame generator base that has an O-ring groove for sealing connection to the housing and an adjacent exposed O-ring groove for sealing connection to the hinged lid.

A feature and advantage of embodiments is a lighter with the opening of the windshield and the opening of a hinged lid are perpendicular or substantially perpendicular to one another. This provides enhanced wind protection and further provides a barrier to contacting the flame. r A feature and advantage of embodiments is that a manually rotatable knob, rotatable without tools, projects from a rearward end of a lighter housing body providing an ergonometric configuration for easy gripping in the lighting-operational orientation. In embodiments, the knob threadedly attached to the flint tube holds the lighter together pulling a flame generating base unitary with the flint tube towards and into the housing body and an O-ring seals the opening.

A feature and advantage of embodiments is that a manually rotatable knob, rotatable without tools, projects from a rearward end of a lighter housing secures main components of the lighter together and closes the flint tube.

In embodiments, the knob engages against a rearward housing cap that is sealing engaged with an open lower end of the housing by sandwiching a seal between the cap and the lower housing margin.

In embodiments, the knob covers a flint reservoir that has a bore with internal threads on the post defining the bore, and threaded cap with external threads is secured in the bore. A coil spring in the bore and engaging the threaded cap urges the flints toward a flint wheel mounted on the flame generator base.

A feature and advantage of embodiments is that the metallic fuel containment housing is contained within non-metallic outer housing components to provide an enhanced gripping and holding surfaces. The outer housing may be a polymer, for example, with a significant lower heat conductivity than the metal of a main body of the fuel containment housing. In embodiments, a non metallic end cap extends over a rearward open end of the main body of the fuel containment housing, and a forward non metallic sleeve extends over the forward end of the fuel containment housing and enclose the metallic forward end of the fuel containment housing and the metallic windshield within the forward outer housing component, the sleeve, when the lighter is in a closed or non use state. Both outer housing components extending radially outward from the inner fuel containment housing such that during handling of the lighter, the metallic inner fuel containment housing is not contacted or is minimally contacted by the user. Particularly in cold ambient conditions, this is more user friendly.

A feature and advantage of embodiments is that the height of the lighter in the use position is significantly less than conventional lighters. First, the lighter has a use position where greatest dimension of the lighter is positioned horizontally. The height then is the second greatest dimension of the lighter. Secondly, the hinged lid is configured as a flap rather than being a cup, and the lid lays along the body barely increasing the height of the lighter. This minimal height of the lighter is more conducive to use in camping for example, to extend the lit lighter into openings in campfire wood piles.

DESCRIPTION OF THE FIGURES

FIG. 21 is a perspective view of a housing sleeve.

FIG. 22 is a perspective view of a housing end cap.

FIG. 23 is a perspective view of the housing end cap of FIG. 22 taken from an opposite side.

FIG. 24 is a perspective view of the housing sleeve of FIG. 21 taken from an opposite side.

FIG. 25 is a perspective view of a lid.

FIG. 26 is a perspective view of the lid of FIG. 25 with the cooperating latch and seal.

FIG. 27 is an exploded view of the lid of FIG. 26.

FIGS. 29A-20C illustrate operating sequence for filling the fuel and flints of a lighter according to embodiments.

DETAILED DESCRIPTION

Figure 2:
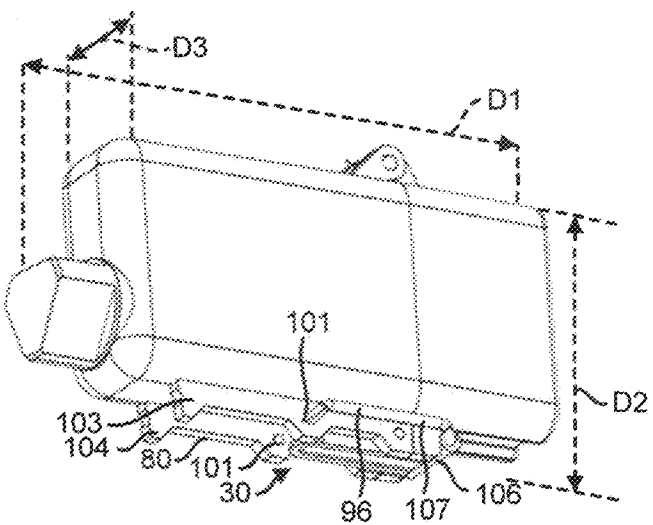
FIG. 2 is a perspective view of the lighter in a closed position.
Figure 4:
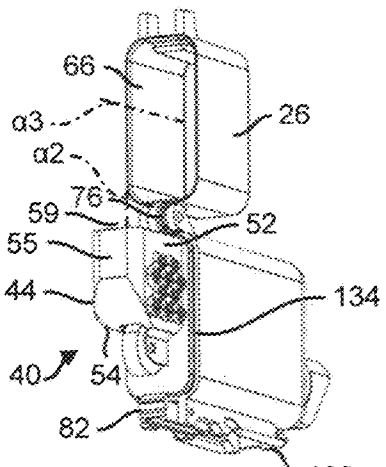
FIG. 4 is a perspective view of the lighter in an open position.
Figure 1:
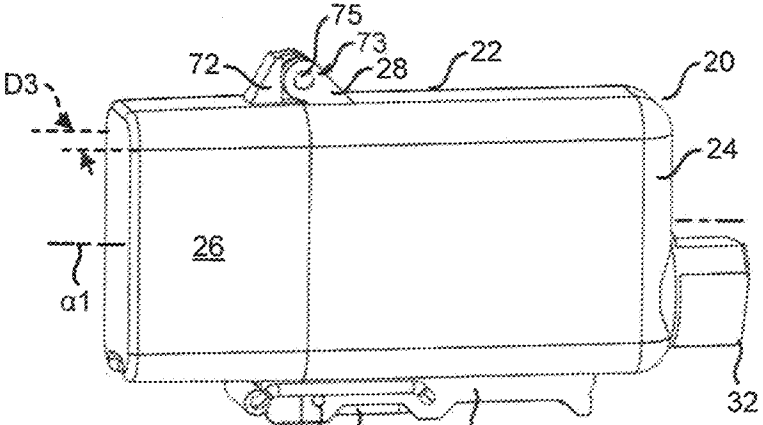
FIG. 1 is a perspective view of the lighter in a closed position.
Figure 3:
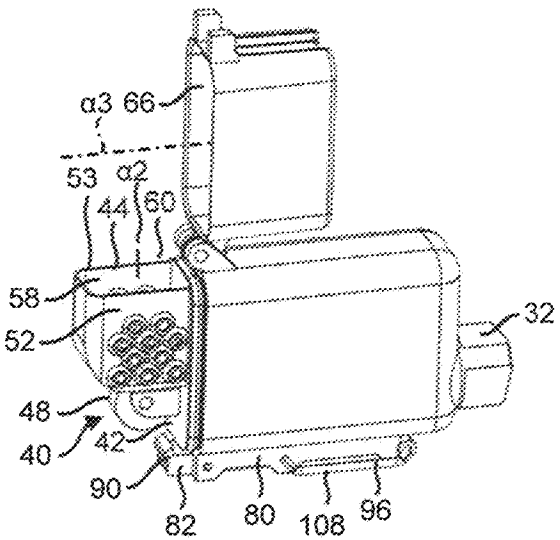
FIG. 3 is a perspective you of the lighter in an open position.
Figure 5B:
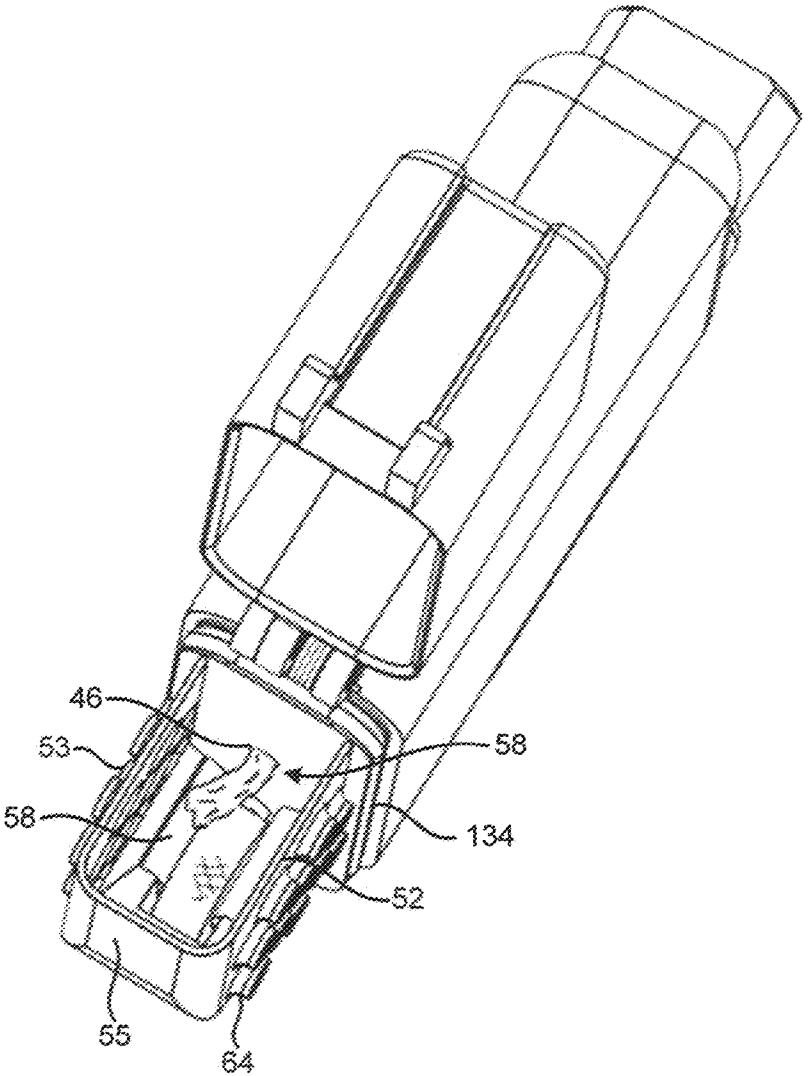
FIG. 5B is a perspective view of the lighter in an open position.
Figure 5A:
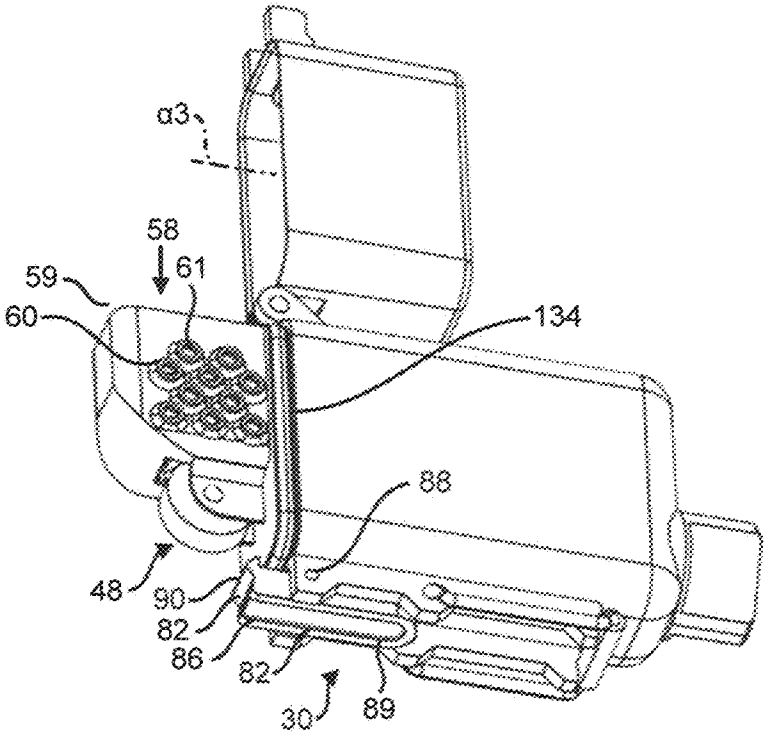
FIG. 5A is a perspective view of the lighter in an open position.
Figure 6:
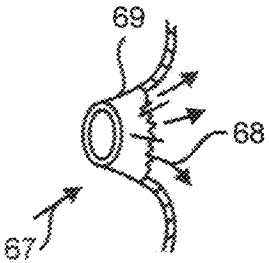
FIG. 6 is a partial cross section of a dimple of the windshield.
Figure 7:
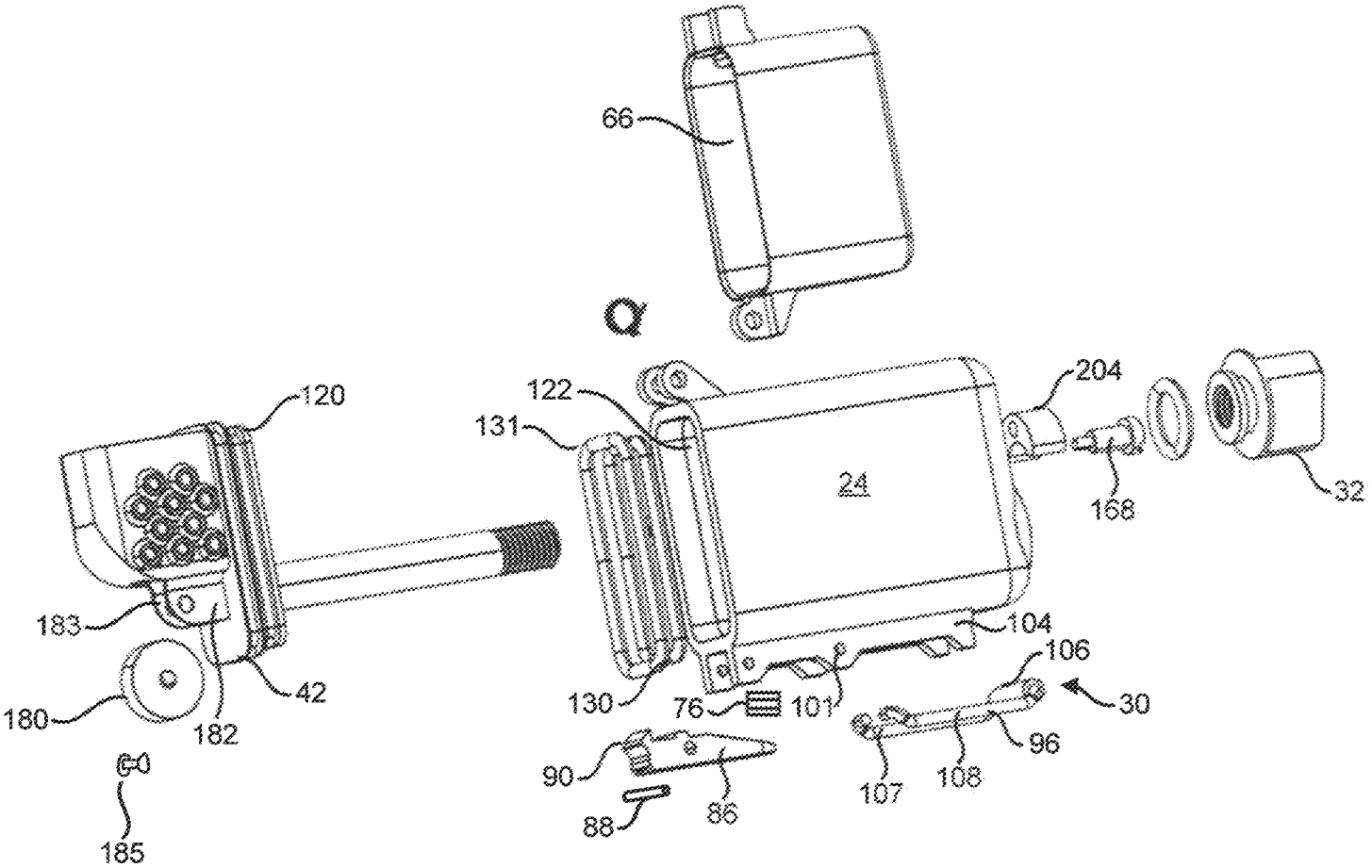
FIG. 7 is an exploded view of the lighter.
Figure 8:
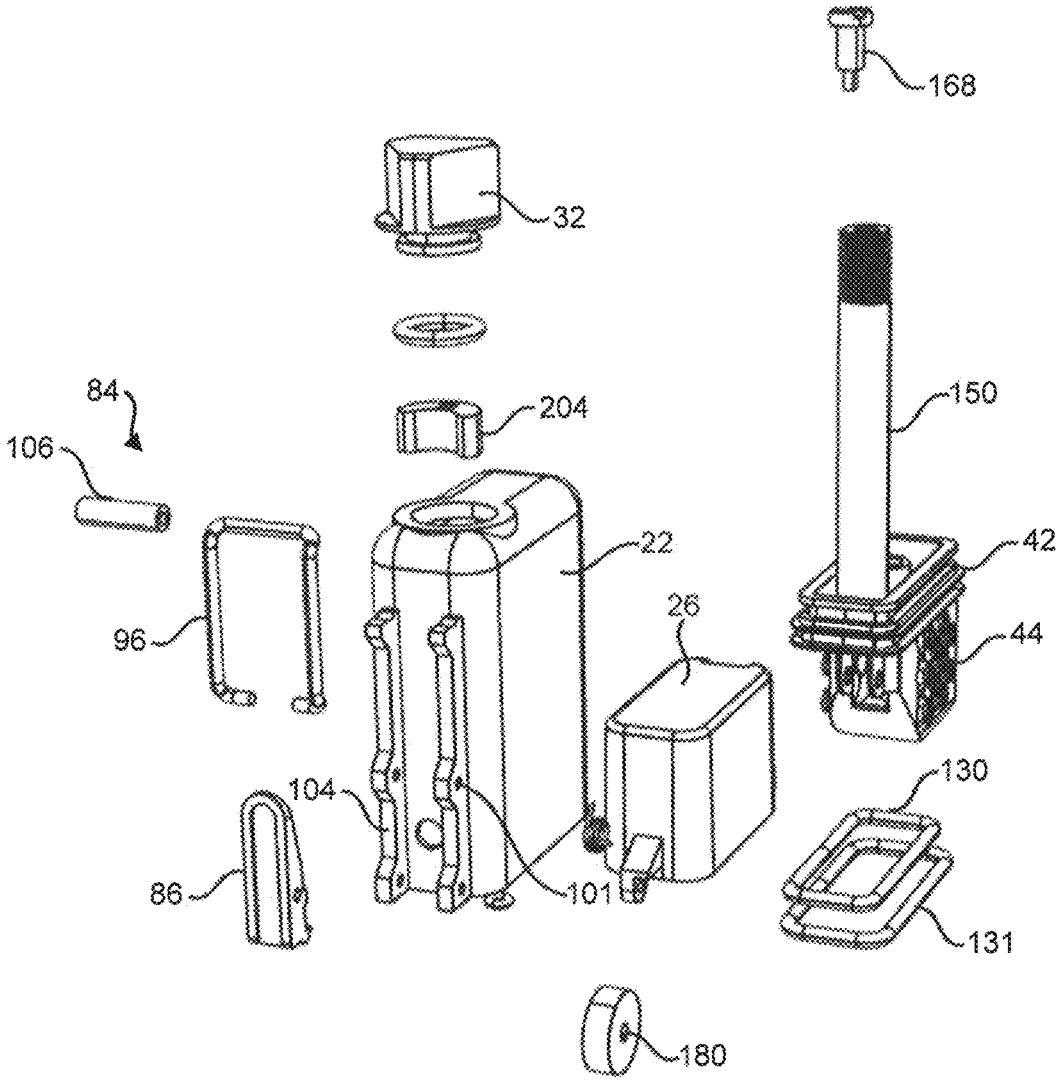
FIG. 8 is another exploded view of the lighter.

Referring to FIGS. 1-6, a lighter 20 is illustrated in a closed position and an open use or operational position and generally comprises a fuel containment housing 22 having a housing body 24 and a lid 26 hingedly connected by way of hinge 28, a latching assembly 30, and a rearwardly extending knob 32. A flame generation assembly 40 is exposed when the lid 26 is opened and comprises a flame generation base 42, windshield 44 extending from the base, a fuel port 46, an ignition means 48 on the base. The lighter has a greatest dimension D1, a length, which extends generally horizontally when the lighter is in a closed position with an axis $\alpha$1 horizontal. The lighter has a second greatest dimension D2, which is a height when in the use position, and a third greatest dimension D3, a thickness or width. Length dimension D1 illustrates the length when and the width dimension will each have a In embodiments, the windshield 44 has four walls, two upright lateral opposing walls 52, 53 extending from the flame generation base, a lower wall 54 also extending from the base 42 connecting the two lateral opposing walls, and an distal upright wall 55 connecting the two lateral opposing walls. The windshield defines an open flame region 58 and a windshield flame outlet 59 which has an axis α2. The lateral side walls have outwardly projecting dimples 60 with apertures 61. The dimples are configured as outwardly projecting nozzle portions 64 formed in the sidewalls. These are believed to provide enhanced wind protection to prevent the extinguishment of a flame, but also providing adequate air for the combustion. As depicted in FIG. 6, high velocity air flow 67 when it enters the opening is slowed to a slower air flow 68 when it expands due to the increasing area of the diverging nozzle 69 of funnel.

The lid defines an opening 66 with an axis α3 that is perpendicular or substantially perpendicular to the axis of the windshield 44. The lid is attached to the housing body 24 by hinge 28 having hinge portions 72, 73 projecting upwardly from the housing body and are connected with hinge pin 75. A spring 76 can urge the lid to the open position.

Referring to FIGS. 1-7, the latching assembly 30 comprises a latching base 80 disposed on the housing body, a first latch 82 and a second latch 84. The first latch may be configured as a lever 86, with a fulcrum configured as a pin 88, and an actuation portion 89, and a hook portion 90 opposite the actuation portion with respect to the pin 88. The hook portion engages structure, such as a lip 91, best shown in FIG. 10, outwardly allowing the lid to be opened. A spring 92, shown in FIG. 7, may urge the lever to the latched position. Depression of the actuation portion 89 pivots the hook portion 90 outwardly allowing the lid to be opened from the closed position.

The second latch 84 comprises a U-shaped latch member 96 that has ends 98 extending into openings 101 on ribs 103, 104 of the latching base 80. A polymer tube or covering 106 may provide an engagement portion for the latch member. The latch member swings from a double latched position shown in FIGS. 1 and 2, to the seated unlatched position of FIGS. 3 and 4. The legs 107, 108 of the member may provide feet for seating on a flat surface. In embodiments, the second latch needs to be unlatched before the first latch can be released, providing assurance that the lid is securely sealed on the housing body 24.

Referring to FIGS. 3-10B, the flame generation assembly includes the flame generation base 42 which has a plate portion 120 which is sized for insertion into the open interior 122 of the housing body 24. A pair of O-ring grooves 126, 128 receive O-rings 130, 131 formed of compliant material that seal the juncture 134 between the housing body 24 and the flame generation base and the juncture 136 between the lid and the flame generation base when the lid is closed.

Figure 10A:
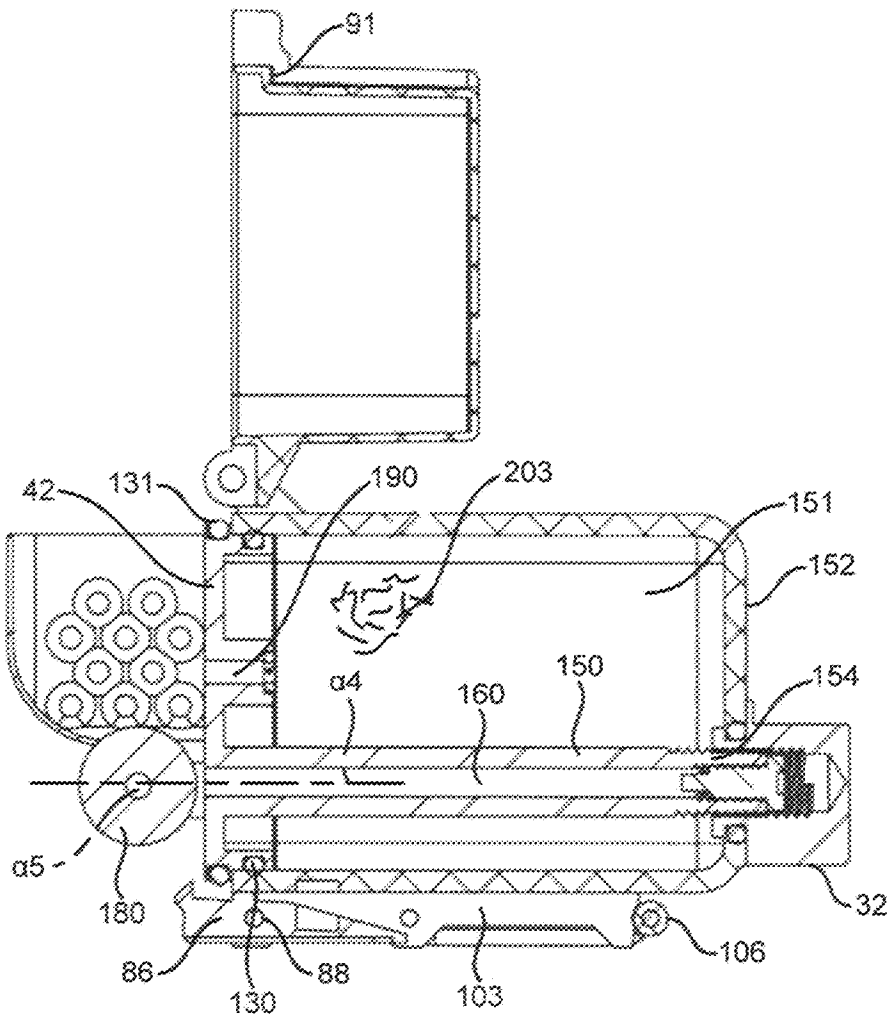
FIG. 10A is a cross-sectional view of the lighter taken at line 10-10 of FIG. 9.
Figure 9:
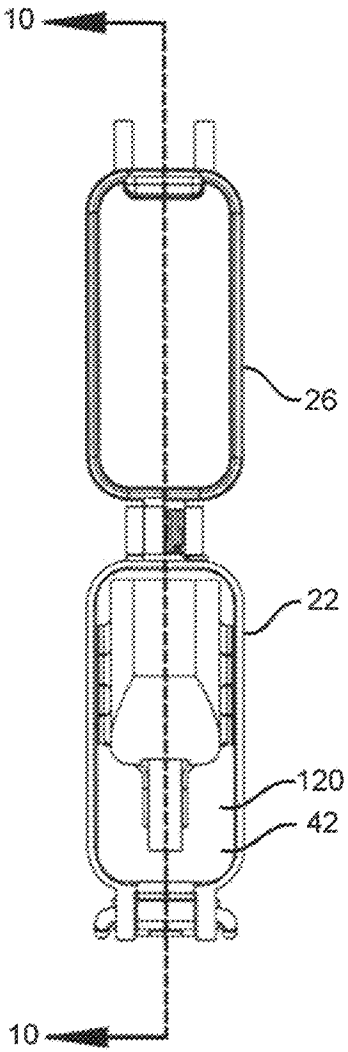
FIG. 9 is an end elevational view of the open lighter.
Figure 10B:
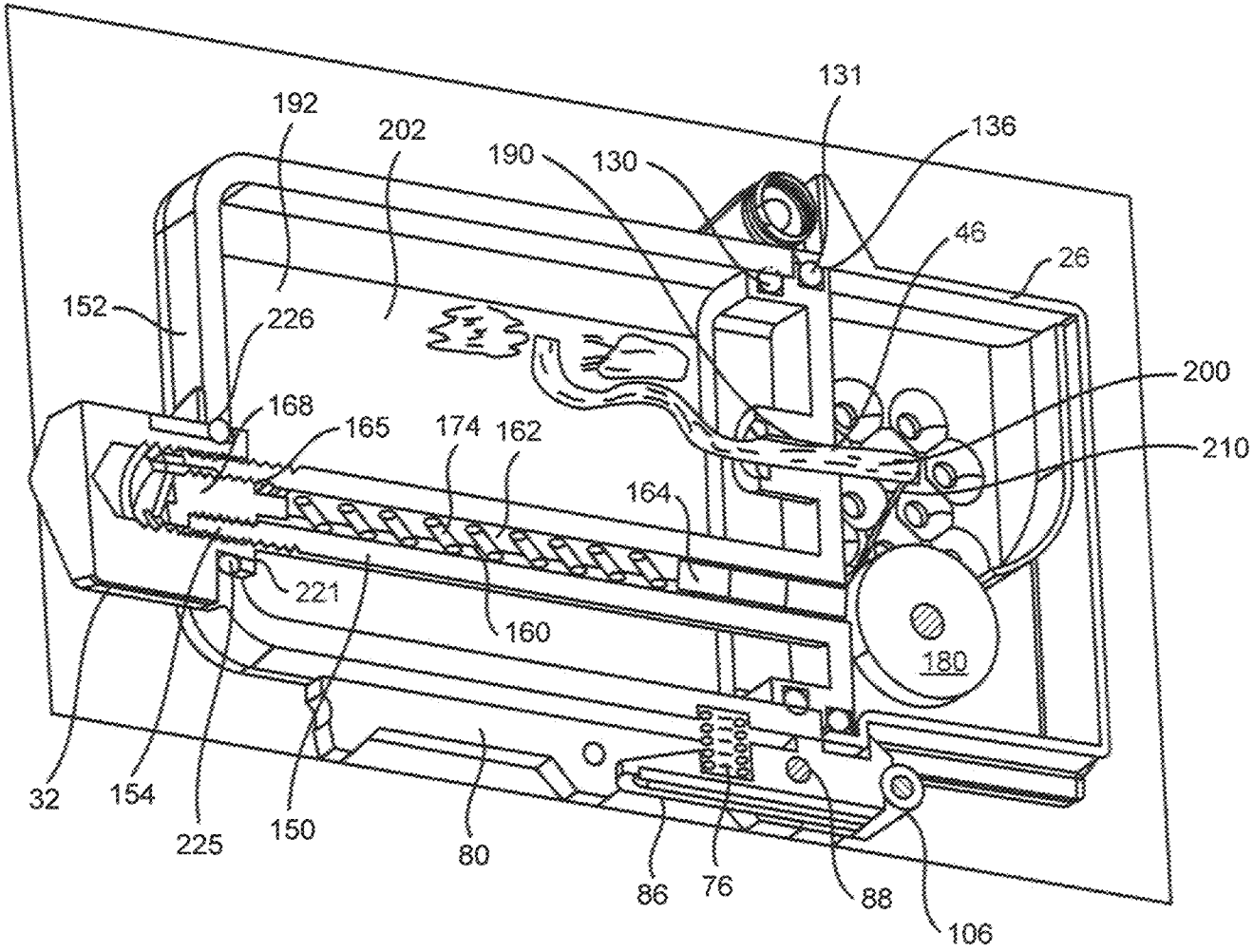
FIG. 10B is another cross-sectional view of the lighter in the closed position.

A post 150 extends from the flame generation base 42 through the fuel reservoir 151 defined by the housing body 24 and flame generation base 42 toward the rearward end 152 of the housing base and has a threaded end 154 to which is attached the knob 32. As best shown in FIG. 10B, the post has an open interior configured as a bore 160 that defines a flint reservoir 162 for receiving flints 164. The flint reservoir having an axis α4. The bore may have interior threads 165 that receive a cap 168 with exterior threads 169. A spring 174 urges the flints 164 toward a flint wheel 180 that is rotatably attached to the flame generation base, such as be supports 182, 183 formed from the windshield and a rivet 185. The flint wheel having an axis of rotation of α5. See FIG. 7, for example. The flame generation base 42 has the fuel port 46 having an opening 190 extending into the open interior 192 of the housing body which may have filament material, such as rayon, to hold liquid lighter fluid. A wick 200 extends into the flame region and into the fluid reservoir 202 defined by the open interior 192 which may be filled with absorbent material 203. A felt pad 204 may be received in the fuel reservoir and fibrous absorbent material held in the reservoir. In embodiments, as best shown in FIG. 10A, the axis α4 of the flint reservoir is offset from the rotational axis α5 of the flint wheel. This provides an advantageous enhanced spark generation as the spark is angled more into the flame region 58 as illustrated by spark 210 in FIG. 10B, and there is more surface to surface contact between the flint and flint wheel compared to conventional arrangement where the axis intersect.

Figure 12:
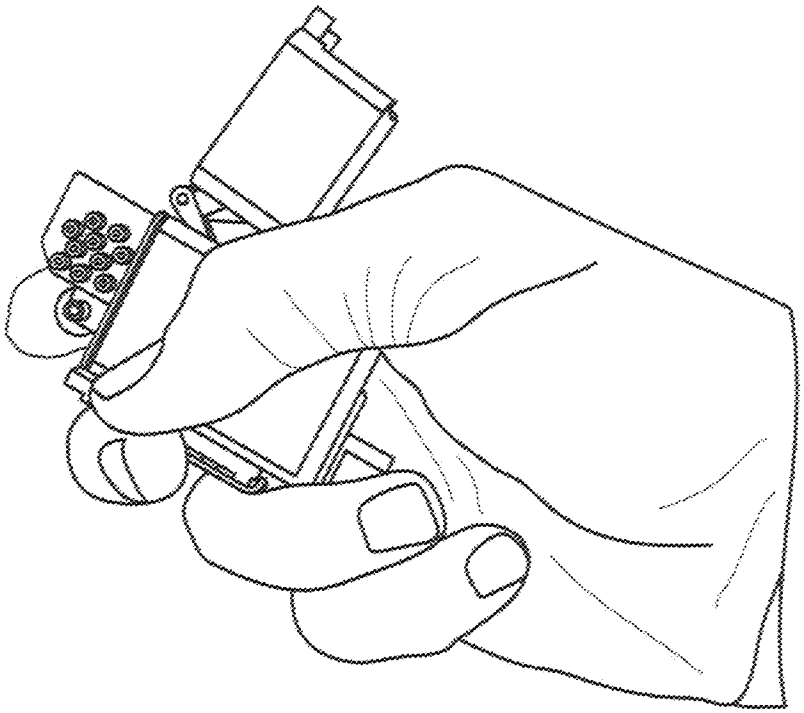
FIG. 12 is another view of the lighter using the fore finger to operate the flint wheel.
Figure 11:
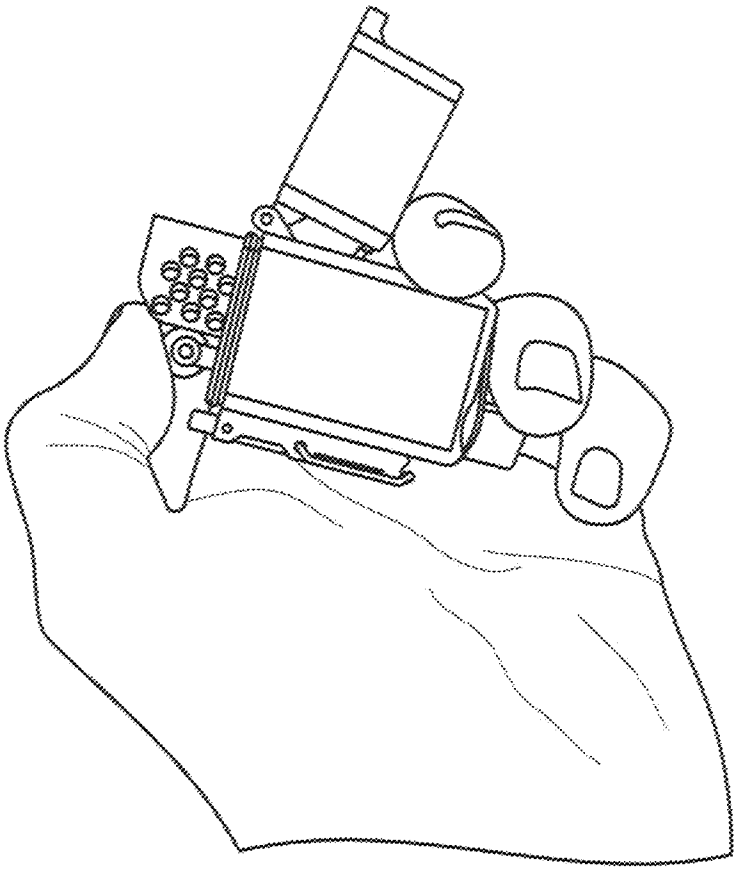
FIG. 11 is a view of the lighter being utilized with a thumb operating the flint wheel.

The knob 32 has an O-ring groove 221 and receives an O-ring 225 that seals the juncture 226 between the knob and housing body 24, precluding leakage of fluid. FIGS. 11 and 12 illustrate optional way to utilize the lighter, the lid, in embodiments, may provide enhanced wind protection. The knob seats comfortably in the palm of the user's hand.

Figure 14:
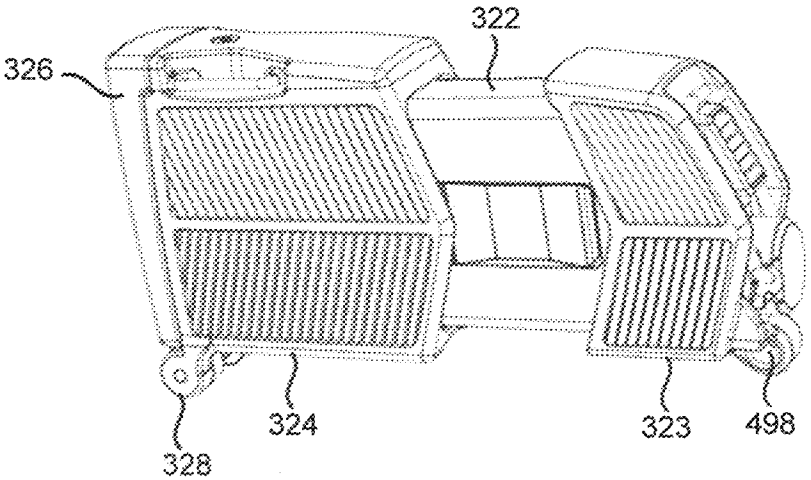
FIG. 14 is another perspective view of the lighter of FIG. 13.
Figure 13:
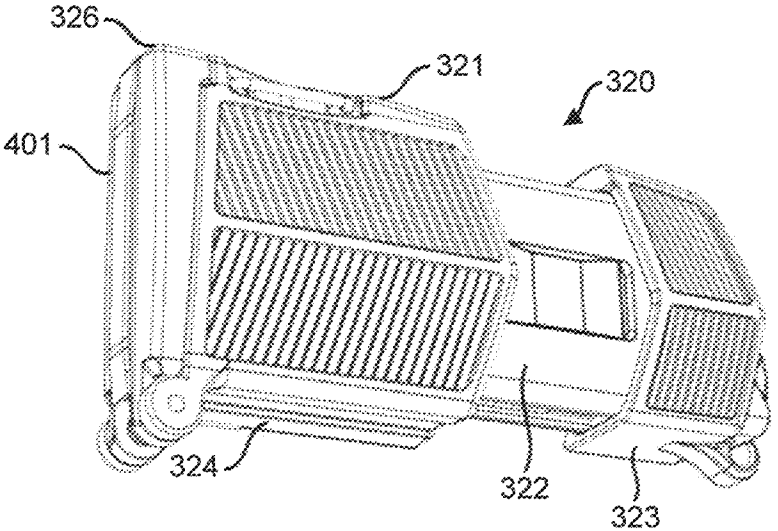
FIG. 13 is a perspective view of an embodiment of a lighter in a accord with embodiments.
Figure 15:
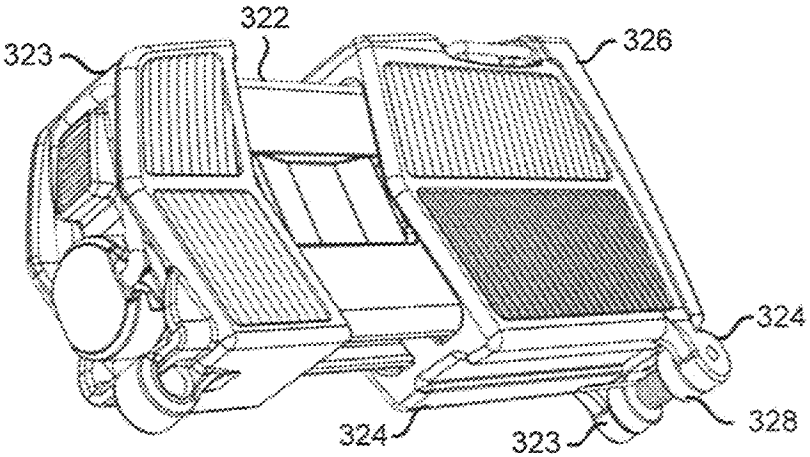
FIG. 15 is a perspective view of the lighter of FIGS. 13 and 14 from the opposite side of those views.
Figure 16:
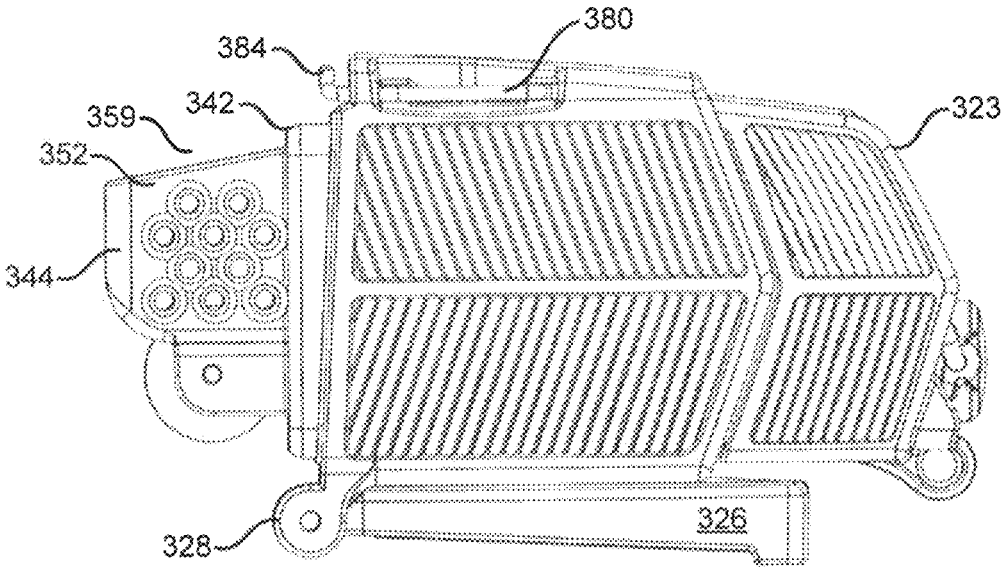
FIG. 16 is a side elevation view of the lighter of FIGS. 13-15 in an open state.
Figure 17:
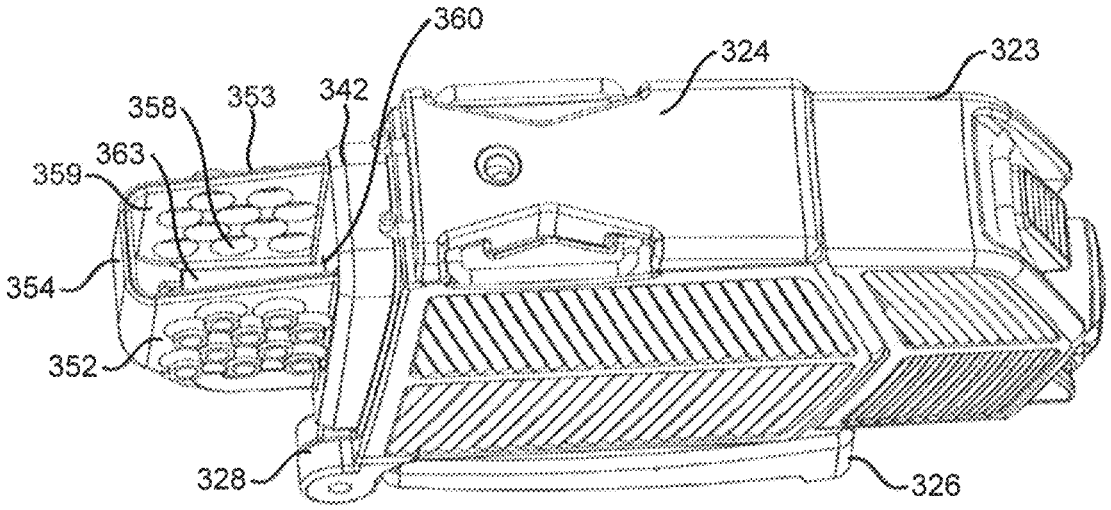
FIG. 17 is a perspective view of the open lighter of FIG. 16 showing the actuation portion.

Referring to FIGS. 13-18, a lighter 320 is illustrated with an outer housing 321 and an inner fuel containment housing 322. The outer housing comprising a pair of outer housing components, a rear housing end cap 323 and a forward housing sleeve 324. A lid 326 connected to the housing sleeve by way of a hinge 328. A latching assembly 330 releasably secures the lid to a forward edge 331 of the housing sleeve 324 as shown in FIGS. 13-15, with the lighter 320 in a closed position or state. FIGS. 16 and 17 show the lighter in an open use position or state with the lid 326 rotated about the hinge 328 to lay along the outer surface 339 of the housing sleeve 324 revealing the flame generation assembly 340 attached to or extending from a flame generation base which in this embodiment is unitary with a main fuel containment housing body 341 and with components of the flame generation assembly 340 mounted to a flame generation base 342. The flame generation assembly includes a windshield 344, with opposing lateral walls 352, 353 extending from the flame generation base. An end wall 353 connects the two opposing lateral walls and the end wall 354 the two opposing lateral walls and the flame generation base 342 defining a flame outlet 359. The windscreen defining an open flame region 358. A fuel port 360 in the flame generation base 342 has an exposed wick 363 extending therefrom.

Referring in particular to FIGS. 13-20 and 25-27, the lid 326 may be configured as a flap with no side walls or minimal sidewalls extending around the margin 364 of the lid toward the housing sleeve 324. The lid 326 is attached to a housing sleeve 324 by hinge portions 372, 373 projecting upwardly from the housing sleeve 324 and are connected with hinge pin 375. A metal coil spring 376 can bias the lid 326 to the open position. The latching assembly 330 can comprise a spring latch member 380 with two latch ends 384, 385 two manual deflectable portions 387, 388, and an end portion 390. The spring latch member 380 held in place by a retention plate 392 having a recess 394 that conforms to the latch member 380 and exposes the two deflectable portions 387, 388 that are laterally exposed. A screw 389 secures the plate and the latch member 380 The latch ends 384, 385 are removably engageable with catch portions 396, 397 on the lid. The two latch ends 384, 385 having a lid retention position when the deflectable portions are not deflected where they are engaged with and capturing the catch portions on the lid 326 and a release position where the deflectable portions are squeezed inward moving the latch ends inward to an open region 399 between the catch portions 396, 397 such that the latch ends 384, 385 release the catch portions of the lid 326 allowing the lid to open under the bias provided by the spring 376. The spring latch member may be formed of spring steel. When released the lid rotates from the position of FIGS. 13-15 to the position of FIGS. 16 and 17 with the lid laying along the outer surface 339 of the housing sleeve with a rib 401 that may cooperate with and interface with an elongate groove 402 on the sleeve. This cooperation and interfacing reduces the overall height of the lighter and provides a more secure seating of the lid on the sleeve. Impacts or forces on the lid, when the lighter is open and the lid seated on the sleeve may be absorbed by the sleeve rather than being transmitted to the hinge with potential damage to the hinge. The lid further has a recess 404 on its inside surface 405 that receives a compliant seal 406 formed of compliant material. When the lid is closed and captured by the latch member, the compliant seal is compressed effectively sealing the lid to the sleeve.

Figure 18:
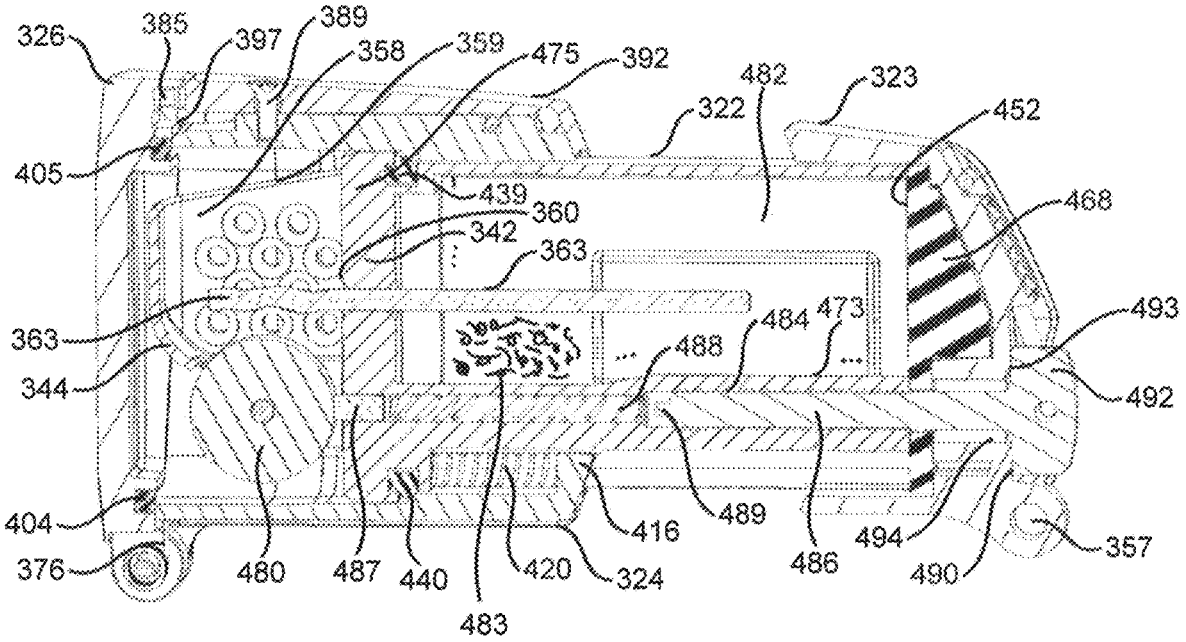
FIG. 18 is a cross section view of the lighter of FIGS. 14-17.

Referring to FIGS. 13-21 and 24, the forward housing sleeve 324 is slidably engaged with the fuel containment housing body 341, sliding between a forward position as illustrated in FIGS. 13-15 and a retracted position as illustrated by FIGS. 16 and 17, these positions corresponding to the closed lighter state and the open use state. The housing sleeve 324 has a tab 416 that rides in slot 418 and engages a spring 420 that is contained within the sleeve between the sleeve and fuel containment housing body 341 as best shown in FIG. 18. The spring 420 is compressed within the sleeve such that a bias is provided to the sleeve to the retracted position of FIGS. 16 and 17. When the lid 326 is released from the captured closed position and rotates about the hinge, the fuel containment housing body 322 then is released to extend out of the sleeve, or in other words, the sleeve is released to retract downwardly toward the housing end cap 323. The housing sleeve 324 as depicted also has tabs 431, 432 that ride in the recesses 435, 436 on opposing sides of the main fuel containment housing body 341. The housing sleeve may be formed of a resilient non metallic material such as polymers that provide a resilient spring action of the tabs into the recesses 345, 346. The recess may have stop indentations 350, 352 at one or both ends of the respective recesses to releasable secure the respective tab therein and consequently provide a position fixation of the sleeve with respect to the fuel containment housing body 341. The tabs 431, 432 function as detents for retention of the sleeve in the fully retracted position and/or the fully extended position corresponding to the open state and closed state of the lighter respectively. The sleeve may have repeating indentations or other surface structure thereon for providing gripping surfaces 357.

Figure 19:
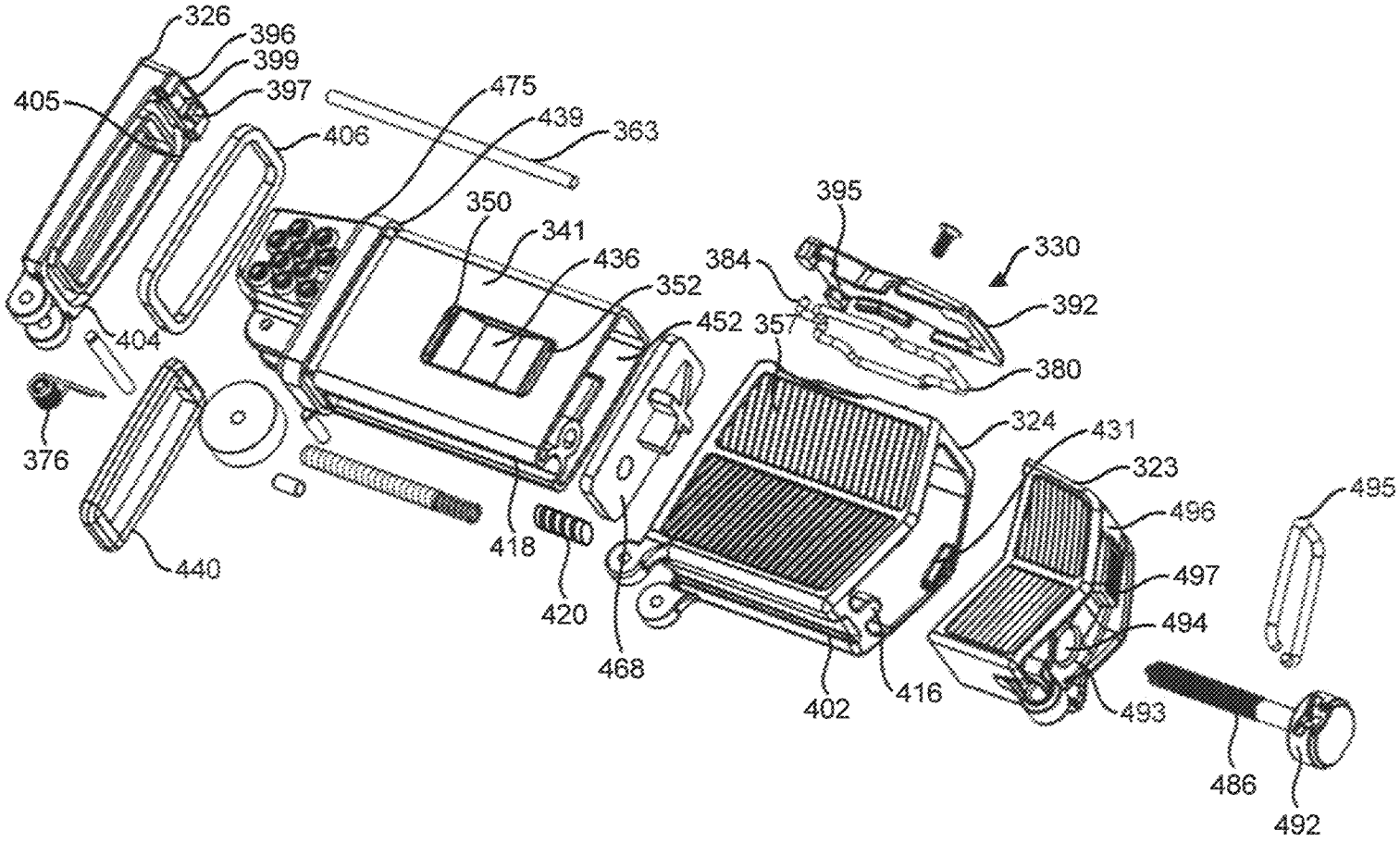
FIG. 19 is an exploded view of the lighter of FIGS. 14-18.
Figure 20:
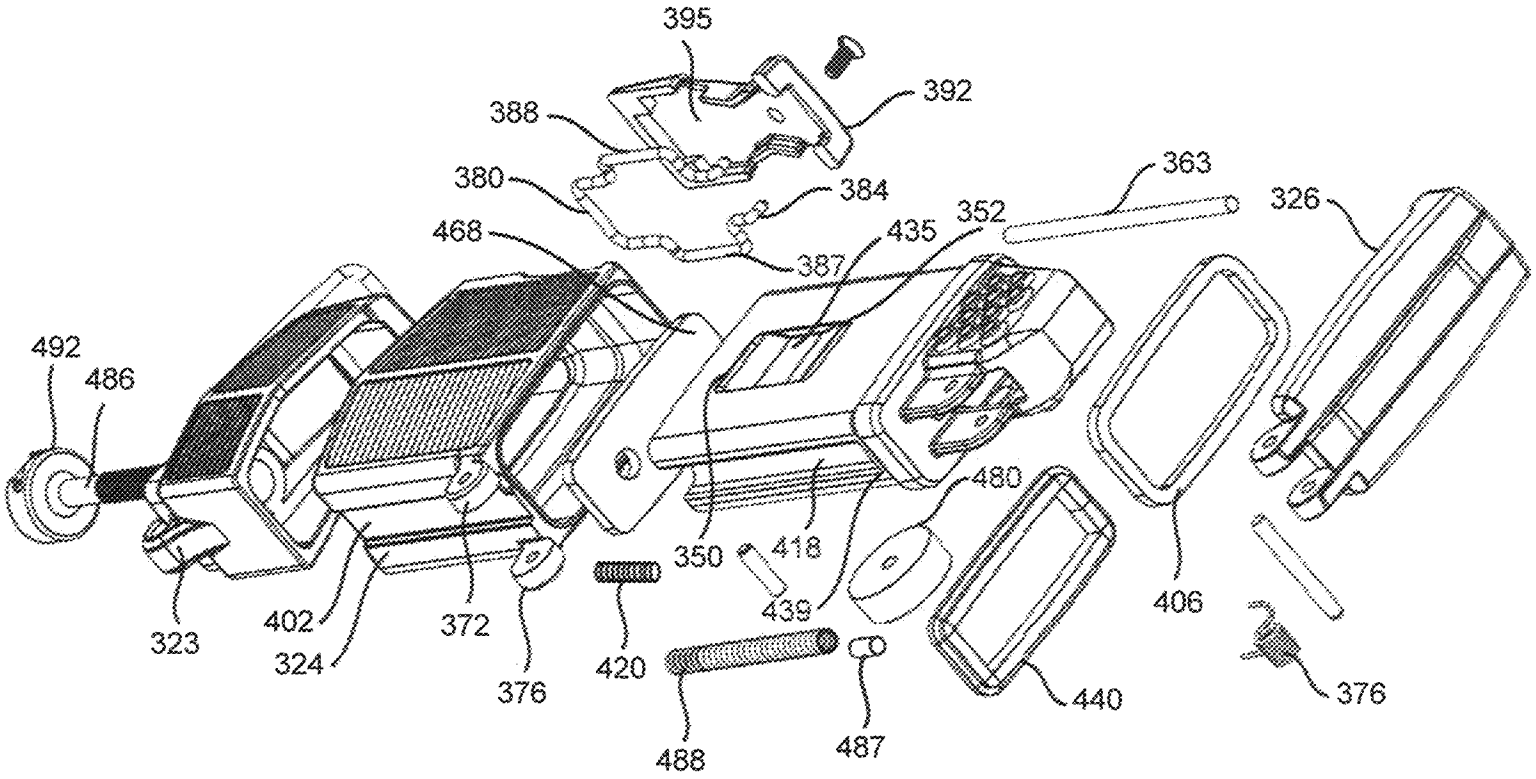
FIG. 20 is an exploded view for the side opposite that of FIG. 19.

Referring to FIGS. 18-20, the fuel containment housing body has a seal groove 439 and compliant seal 440 therein that engages the inside surface of the housing sleeve when the housing sleeve is in its full forward position corresponding to the closed state of the lighter. This seal 440 in conjunction with the seal 406 on the lid 326 provides a sealed chamber enclosing the flame generation assembly thereby minimizing leakage or evaporation of the fuel.

Referring to FIGS. 18-20 and 22-23, in embodiments, the main fuel containment housing body 322 has the flame generation base 342 unitary with the containment wall 448 that extends rearwardly from the base 342. The main fuel containment housing body 322 has a rearward opening 452 opposite the flame generation base that is capped by the housing end cap 323. The housing end cap 323 may also be made of a polymer, such as the polymer of the housing sleeve, and have surface indentations or structure defining gripping surfaces 457. The housing end cap 323 is conformingly sized to the exterior circumference 459 at the rearward end 461 of the fuel containment housing body 322 and has a recess 465 on the surface 466 facing the fuel containment housing body that receives a compliant seal 468 formed of compliant material 469. The seal 468 is conformingly sized to the recess 465 and engages and seals against the rearward edge 470 of the fuel containment housing body 322.

Continuing to refer to FIGS. 18-20 and 22-23, in embodiments, the fuel containment housing also has a post 473 configured as a tube extending from the forward end 475 of the fuel containment housing body 341, the forward end configured as the flame generation base 342. The tube positioned at the flame generation base at and opening to the flint wheel 480 for providing a column of flints to engage the flint wheel. The tube extending through the fuel reservoir 482 defined by the fuel containment housing to terminate at or about at the rearward opening 452. The fuel reservoir may have fibrous material 483 for absorbing lighter fuel. The tube 473 having internal threads 484 that cooperate with threaded member 486 for loading the flints 487 in the tube and also for clamping together the housing components of the lighter. Specifically, the threaded member has an exterior handle or knob 492 integrated with the threaded member 486, the inside surface 490 of the knob 492 engages the exterior surface 493 of the end cap 323 and extends through opening 494 in the end cap. As the knob is rotated, the end cap 323 is drawn toward the fuel containment housing sandwiching the seal 468 between the end cap and the rearward and open end of the fuel containment body 341. The threaded member also effecting a forward bias to flints 487 by way of the tip 489 of the threaded member engaging the flint spring 488. The end cap 323 may have a pivoting extension handle 495 extending therefrom that may be used to provide addition leveraged force to rotate the threaded member to tighten and untighten the member for loading flints 487 or refueling the lighter as explained below. The pivoting extension handle may be received in a recess 496 defined on the outer surface 497 of the exterior housing end cap 323. The housing end cap 323 may also have an aperture 498 for receiving a tether or strap.

Figure 28A:
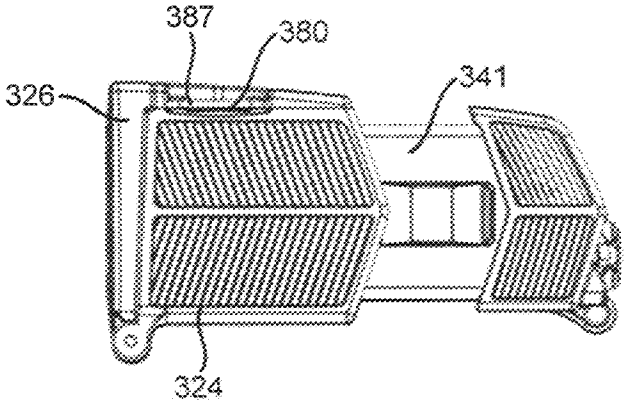
FIGS. 28A-28D show an operating sequence of a lighter according to embodiments.
Figure 28B:
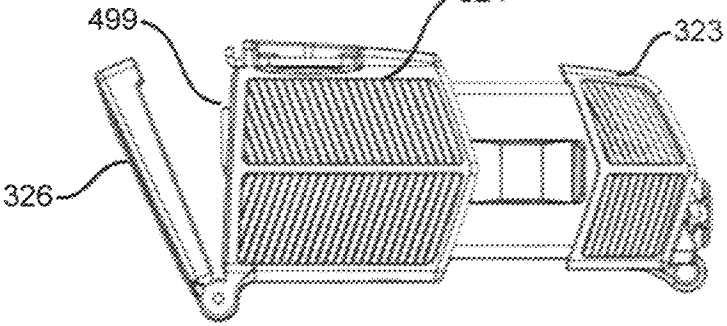
Figure 28C:
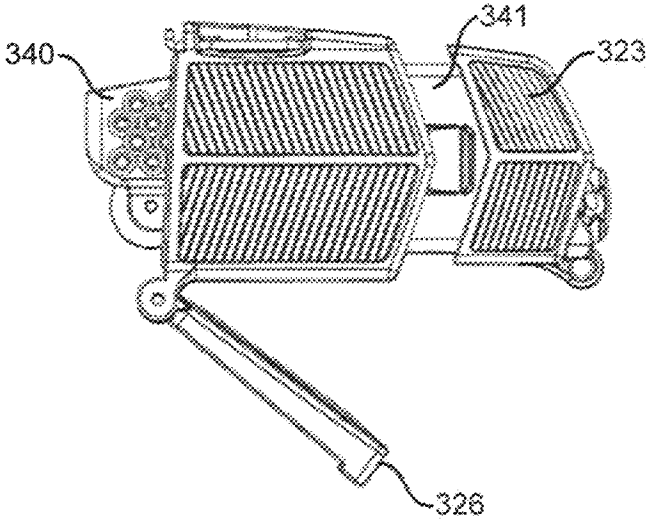
Figure 28D:
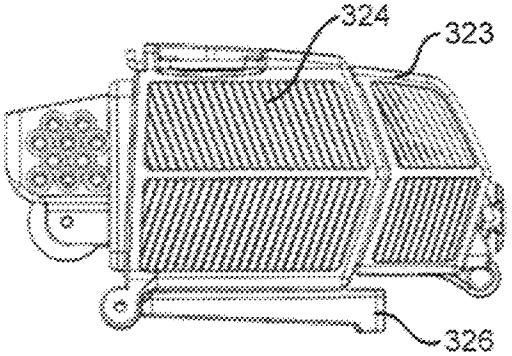
Figure 30B:
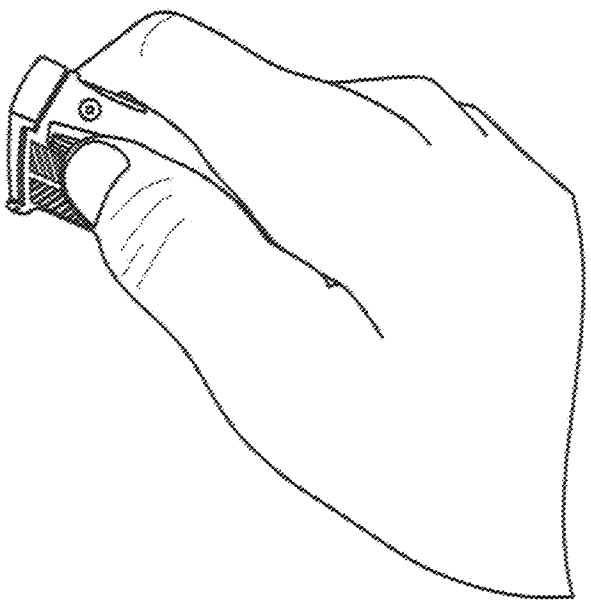
FIG. 30B is a view of the user depressing the actuator of the lighter of FIG. 30A.
Figure 30C:
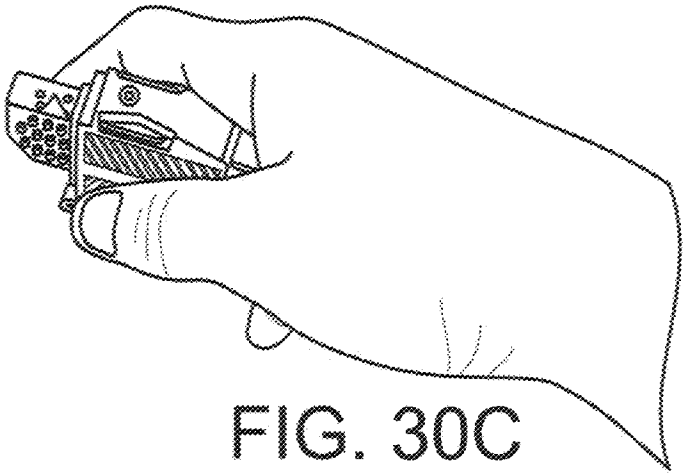
FIG. 30C is a view of the lighter with lid opened and the flame generation assembly extending from the housing.
Figure 30A:
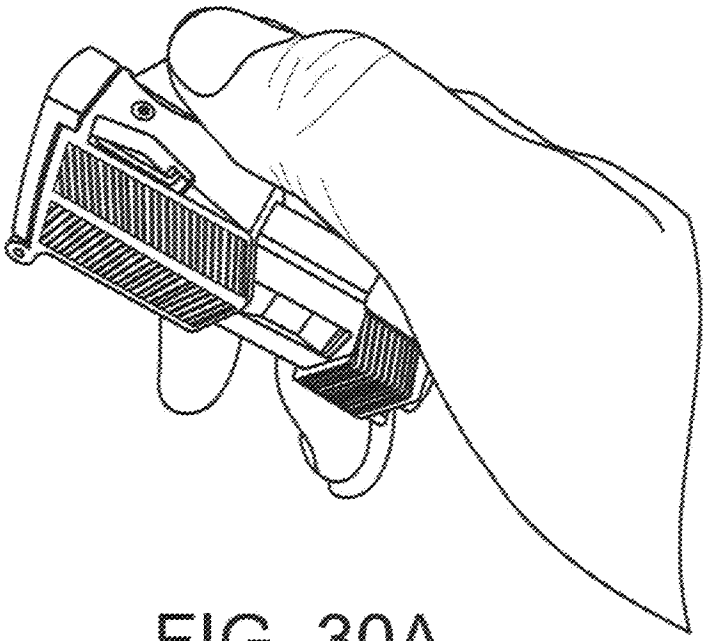
FIG. 30A is a view of user holding the lighter.

Referring to FIGS. 28A-28D and 30A-30C, operation of embodiments of the lighter 320 are illustrated. The lighter is intended to be operated in more of a horizontal manner than conventional wicked lighters. The closed lighter of FIGS. 28A and 30A may be actuated to transition between the closed state to the open state by actuation of the latching system by pushing inwardly on the deflectable portions 387, 388 of the latch member 380 which releases the lid 326 as shown in FIGS. 28B and 30B. The lid 326 rotates about the hinge 328 toward the housing sleeve 324. With the clearance of the lid 326 from the open front 499 of the housing sleeve 324, the biased fuel containment housing body 341, specifically the flame generation assembly 340, can extend out of the open front 499 as shown in FIG. 28C. As the sleeve extends downward to its fully seated position, which may be in engagement with the end cap 323, the lid has seated on the exterior surface of the housing sleeve. The user may then rotate the flint wheel to provide a spark to light the exposed wick.

Figure 29C:
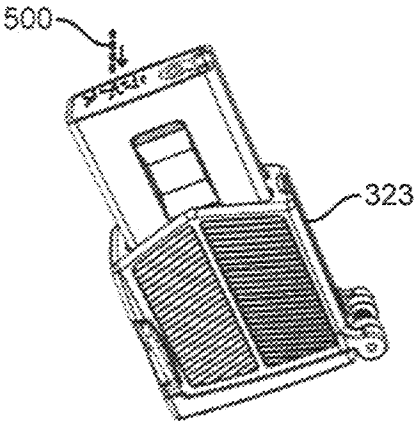
Figure 29B:
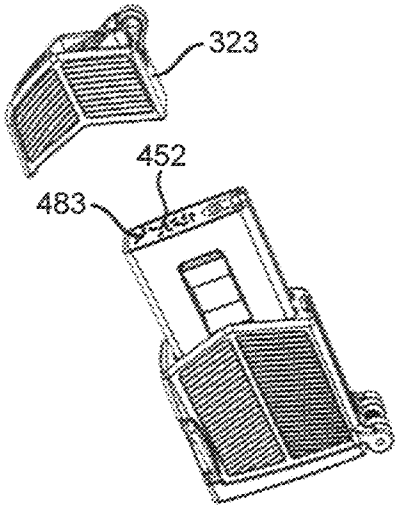
Figure 29A:
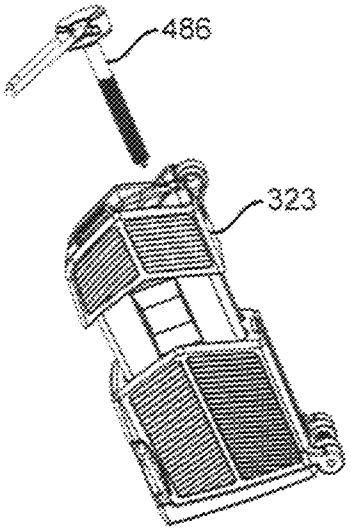

Referring to FIGS. 29A-29C, steps to load flints and lighter fluid are disclosed. The threaded member 486 is unscrewed from the fuel containment housing body 341 allowing removal of the end cap 323. The flint spring 488 may be removed by rotating the rearward end of the fuel containment housing downwardly (not shown in these views). Flints may be inserted in the tube 473 and fuel 500 may be added to the absorbent material 483 exposed at the open end 452 of the fuel containment housing body 341. The flint spring may be reinserted in the tube and the end cap 323 may then be reinstalled with the threaded member 486 inserted in the tube and tightened, closing the flint tube, biasing the flints towards the flint wheel, and clamping the lighter housing components together and compressing the compliant seal between the end cap and the fuel containment housing body.

In embodiments, the lighter is known as a cigarette or cigar lighter, the volumetric space occupied by the lighter is relatively small, from 2 cubic inches to 4 cubic inches. The weight of the lighter is less than 4 ounces.

In embodiments, the ignition means may be electronic and the fuel may be a gaseous fuel such as butane. See, for example U.S. Pat. Nos. 32,800,600, 7,654,821, 5,055,034, 3,353,376, 2,424,781, 4,128,393, 3,521,985, 2,867,753, 3,311,789. The above references in all sections of this application are herein incorporated by references in their entirety for all purposes.

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

I claim:

1. A lighter having an elongate axis comprising:

a flame generator assembly mounted on a forward end of a fuel containment housing, the flame generator assembly comprising a windshield comprising two lateral sidewalls with a plurality of dimples projecting outwardly with central apertures on each dimple and defining a flame opening; and an outer housing sleeve slidingly positioned on and extending around the fuel containment housing, the outer housing sleeve having a hinged lid configured as a rigid flap, positioned at a forward edge of the outer housing sleeve, the lighter having a closed position and an open operational position, wherein, when in the closed position, the flame generation assembly is substantially or completely within the outer housing sleeve and is contained within a sealed chamber defined by the hinged lid sealingly engaged with the forward edge of the outer housing sleeve, and wherein, when in the open operational position, the hinged lid is rotated to a position with an outer surface of the hinged lid laying along an outer surface of the outer housing sleeve and the flame generator is substantially beyond the forward edge of the outer housing sleeve.

2. The lighter of claim 1, wherein the sealed chamber is further defined by an inner housing compliant seal positioned rearward of the forward edge of the outer housing sleeve and positioned to be compressed between an inner surface of the outer housing sleeve and the fuel containment housing when the lighter is in the closed position, and wherein when the lighter is in the open operational position the inner housing compliant seal is not compressed between the inner surface of the outer housing sleeve and the fuel containment housing.

3. The lighter of claim 1, and wherein the flame opening defines a flame opening axis, the flame opening positioned in a perpendicular direction with respect to the elongate axis, whereby when the lighter is held with the elongate axis in a horizontal direction, the flame opening of the windshield is oriented upwardly.

4. The lighter of claim 1, wherein the flame opening of the windshield opens in a direction generally perpendicular to the elongate axis.

5. A lighter comprising:

a flame generator assembly on a forward end of a fuel containment housing, the flame generator assembly comprising a windshield with an open side and comprising two lateral sidewalls with a plurality of dimples projecting outwardly with central apertures on each dimple and defining a flame opening; and a plurality of outer housing components slidingly positioned on opposing sides of the fuel containment housing, the plurality of outer housing components including a lid and an outer housing sleeve, the lighter having a closed position and an open operational position, wherein when in the closed position, the forward end of the fuel containment housing is retracted in the outer housing sleeve and with the lid sealingly enclosing the flame generator assembly.

6. The lighter of claim 5, further comprising a flint wheel positioned on the same side of the windshield as a hinge of the lid.

7. The lighter of claim 5, wherein the lid has compliant seal seated in a groove therein to seal with the outer housing sleeve.

8. A lighter having an elongate axis, comprising:

an inner metallic fuel containment housing body;

a flame generation assembly forwardly mounted on the inner metallic fuel containment housing body at a forward end of the inner metallic fuel containment housing body, wherein flame generator assembly comprises a windshield having a flame opening with a flame opening axis positioned in a perpendicular direction with respect to the elongate axis, whereby when the lighter is held with the elongate axis in a horizontal direction, the flame opening of the windshield is oriented upwardly, wherein the windshield has two lateral sidewalls with a plurality of dimples projecting outwardly with central apertures on each dimple; and a rigid outer non-metallic housing that extends around a circumference of the inner metallic fuel containment housing body, the rigid outer non-metallic housing extending around a circumference at the forward end of the metallic fuel housing body and extending around a circumference at a rearward end of the metallic fuel housing body.

9. The lighter of claim 8, wherein the lighter has a hinged lid that sealingly closes the windshield when the lighter is in the closed position, the hinged lid attached to the rigid outer non-metallic housing below the windshield when the elongate axis of the lighter is horizontal.

10. The lighter of claim 8, wherein the rigid outer non-metallic housing comprises a forward outer housing sleeve and a rearward outer housing component.

11. The lighter of claim 10, wherein the rearward outer housing component defines an end cap for the inner metallic fuel containment housing.

12. The lighter of claim 8, wherein the rigid outer non-metallic housing has at least a portion thereof that is slidable on the inner metallic fuel containment housing body.

13. The lighter of claim 8, wherein the outer non-metallic housing comprises a non-metallic slidable forward outer housing sleeve, the non-metallic slidable forward outer housing sleeve slidable with respect to the inner metallic fuel containment housing body.

14. The lighter of claim 8, wherein a lid is hingedly attached to a forward edge of the non-metallic slidable forward outer housing sleeve, and wherein a compliant seal material seals a juncture between the lid and the forward edge of the non-metallic slidable forward outer housing sleeve.

15. The lighter of claim 14, wherein the lighter has a closed non-use state and an open-use state, and wherein an actuator is attached to the forward sleeve to effect transition between the closed non-use state and the open-use state.

16. The lighter of claim 15, wherein the actuator is one of a hinged lever and a wire catch member.

17. The lighter of claim 14, wherein the lid is biased toward an open position and the lighter further comprises a latch for retaining the lid in a closed position.

* * * * *